US007764914B2

(12) United States Patent
Barton et al.

(10) Patent No.: US 7,764,914 B2
(45) Date of Patent: Jul. 27, 2010

(54) FUSER BELT ASSEMBLY

(75) Inventors: Augusto E. Barton, Webster, NY (US); James J. Padula, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 11/928,423

(22) Filed: Oct. 30, 2007

(65) Prior Publication Data

US 2009/0110450 A1 Apr. 30, 2009

(51) Int. Cl.
*G03G 15/20* (2006.01)

(52) U.S. Cl. ..... 399/329

(58) Field of Classification Search ..... 399/67, 399/328, 329, 331; 219/216
See application file for complete search history.

(56) References Cited

U.S. PATENT DOCUMENTS 6,829,466 B2 12/2004 Finn et al.
7,062,211 B2 6/2006 Baba et al.
7,113,717 B2 9/2006 Bott et al.
2007/0071520 A1* 3/2007 Tsuchiya et al. ..... 399/329
2008/0219726 A1* 9/2008 Fukai ..... 399/329

FOREIGN PATENT DOCUMENTS

JP 2006053494 A * 2/2006
JP 2007127829 A * 5/2007

* cited by examiner

*Primary Examiner*—Robert Beatty
(74) *Attorney, Agent, or Firm*—Oliff & Berridge, PLC

(57) ABSTRACT

A fuser belt assembly of a xerographic marking device is provided with an endless fuser belt having an inner side and an outer side, a pressure pad movable between a cammed-in position in which the pressure pad contacts an inner side of the fuser belt to press an outer side of the fuser belt against a fuser roll to form a fusing nip, and a cammed-out position in which the pressure pad does not press the fuser belt against the fuser roll. The pressure pad includes two or more embedded pressure sensors for sensing a load of the pressure pad in the cammed-in position, and one or more preload adjustment screws for adjusting the load on the pressure pad based on the sensed pressure pad loads.

14 Claims, 10 Drawing Sheets

FIG. 3
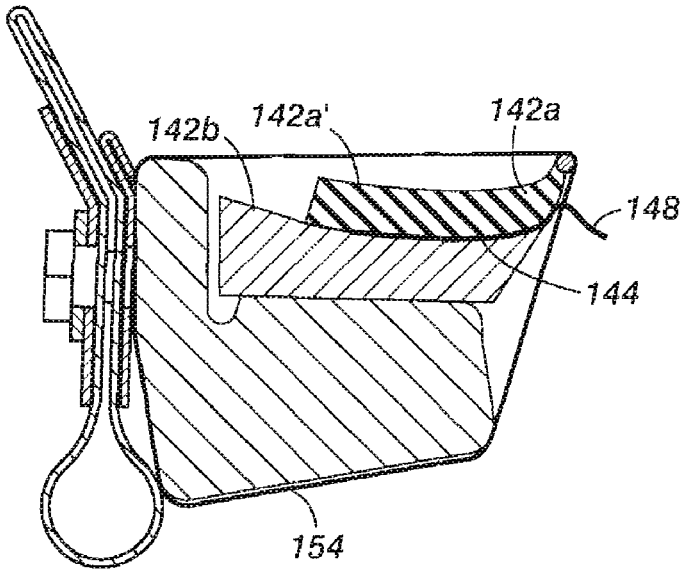
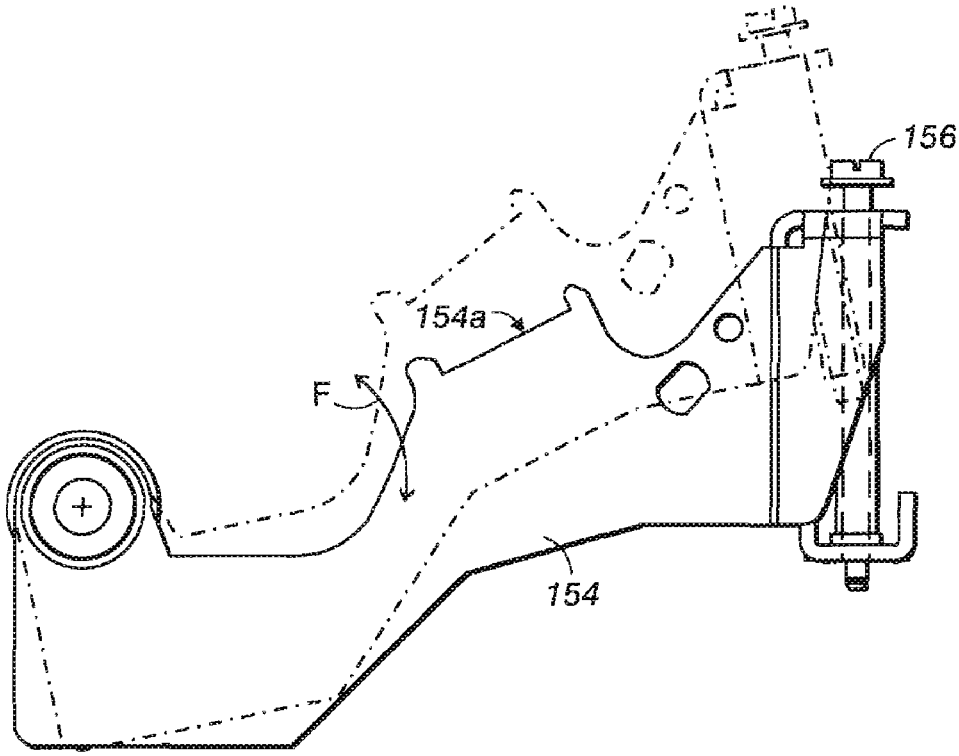
FIG. 4

FUSER BELT ASSEMBLY

BACKGROUND

This disclosure relates to maintaining print quality in xerographic developer systems. More particularly, the teachings herein are directed to apparatus and methods for operating a fuser belt assembly of a belt-nip fuser system in which a nip load profile can be sensed for use in pressure pad calibration.

Generally, the process of electrophotographic printing includes charging a photoconductive member such as a photoconductive belt or drum to a substantially uniform potential to sensitize the photoconductive surface thereof. The charged portion of the photoconductive surface is exposed to a light image from a scanning laser beam, a light emitting diode (LED) source, or other light source. This records an electrostatic latent image on the photoconductive surface. After the electrostatic latent image is recorded on the photoconductive surface, the latent image is developed in a developer system with charged toner. The toner powder image is subsequently transferred to a copy sheet and heated to permanently fuse it to the copy sheet in a fusing station.

A fusing station of a belt-nip fuser system typically includes a heated fuser roll and a fuser belt assembly formed by an endless fuser belt stretched by a plurality of rolls. Positioned within the fuser belt is a pressure pad movable between an operating position in which it is pressed against the fuser roll by the fuser belt to form a fusing nip, and a non-operating position where the pressure pad is moved away from the fuser belt.

In the operating position, the pressure pad engages an inner surface of a moving endless fuser belt and a load is placed on the pressure pad. The load on the pressure pad should be maintained at optimal settings that are balanced along the center as well as inboard and outboard edges of the pressure pad. If the load is too low or asymmetrical, image defects can occur on printed documents. Excessive loading on the pressure pad can cause excessive wear requiring frequent replacement of the pressure pads.

In various commercial products, the nip of the fuser is adjusted at the factory to within exacting tolerances, such as by placement of a pressure transducer pad placed between a fuser roll and a pressure belt. Adjustments in pressure across the length of the fuser nip is made by adjusting fuser pad preload springs to obtain a suitable pad force symmetrical distribution across the center, inboard and outboard edges. However, when the fuser belt assembly is replaced after its useful life, there is currently no procedure to accurately set the nip back to factory settings. Moreover, due to mechanical tolerances of the pressure pads, factory symmetrical settings cannot be assured upon replacement.

SUMMARY

Current embodiments of high speed color printers are capable of printing, for example, up to 80 pages per minute onto media having a weight of from 16 lb. bond to 90 lb. text. As print speeds increase, operational limitations associated with fusing stations become more significant. Conventional fusing belt assemblies utilize pressure pads having operational parameters that are set in the factory when the fusing belt assemblies are manufactured. During operation, the operational settings such as the pressure distribution provided along the fusing nip by the pads are not calibrated. Instead, the pressure pads are replaced at certain production intervals, such as, for example, after being used to print 300,000 sheets of media.

However, due to excessive wear or replacement, the factory operational parameters, such as nip settings, become out of specification. Improper settings result in sub-standard print quality and may induce certain noticeable print defects. One example is toner drag failure, where toner particles being fused may be dragged and fused away from an initial position. Methods for measuring and calibrating the load along a pressure pad in its operating position that are reliable, cost-effective and easy to implement are needed to maintain high levels of print quality in high speed printers.

To maintain high levels of print quality, particularly with high speed printers, the pressure along a pressure pad in its operation position should be measured in a reliable and cost effective manner, and if necessary, calibrated. One area of concern is the effective life of pressure pads. There are many shortfalls associated with the operation and maintenance of pressure pads in fuser belt assemblies.

In embodiments disclosed herein, a fuser belt assembly of a xerographic marking device for a belt-nip fuser is provided. The fuser belt assembly includes an endless fuser belt having an inner side and an outer side, a pressure pad movable between (1) a cammed-in position in which the pressure pad contacts an inner side of the fuser belt to press an outer side of the fuser belt against a fuser roll to form a fusing nip, and (2) a cammed-out position in which the pressure pad does not press the fuser belt against the fuser roll.

In embodiments, the pressure pad is provided with two or more embedded pressure sensors for sensing a load of the pressure pad in the cammed-in position.

In embodiments, the pressure pad has two pressure sensors being positioned along a longitudinal axis of the pressure pad symmetric about a mid-point.

In other embodiments, the pressure pad has three pressure sensors, one of the sensors being positioned along a longitudinal axis of the pressure pad at a mid-point, and two of the sensors being positioned along a longitudinal axis symmetric about the mid-point. Other embodiments include a pressure pad having four or more embedded pressure sensors that are positioned along the pressure pad symmetric about the mid-point of the pressure pad.

In various embodiments, the fuser belt assembly may include a connector that is electrically connected to each of the sensors. The connector may be adapted for connection to a hand-held instrument that measures the pressure of each sensor.

In certain embodiments, one or more adjustable preload screws are provided for adjusting the load on the pressure pad in the field based on the measured loads from the pressure sensors to perform calibration of a fuser belt assembly.

In exemplary embodiments, a method is provided for calibrating a pressure pad of a belt-nip fuser assembly of a xerographic marking device. The method may include moving the pressure pad into a cammed-in position relative to a fuser roll, measuring a load of each of two or more pressure sensors embedded in the pressure pad, adjusting as necessary the pressure pad, and re-measuring the load of each of the pressure sensors.

In various embodiments, the measuring step may also include connecting an instrument to a single connector that is in electrical connection with each of the pressure sensors.

In various embodiments, the method includes adjusting one or more preload screws and the adjusting step comprises loosening or tightening one or more of the preload screws.

In embodiments, the pressure pad has an inboard side and an outboard side and the adjusting step includes balancing the loads on the respective inboard and outboard sides of the pressure pad. The adjusting step may also include setting a symmetrical pressure distribution at required levels.

While specific embodiments are described, it will be understood that they are not intended to be limiting. These and other objects, advantages and salient features are described in or apparent from the following detailed description of exemplary embodiments.

BRIEF DESCRIPTION OF THE DRAWINGS

Exemplary embodiments will be described with reference to the drawings, wherein like numerals represent like parts, and wherein:

FIG. 3 is a side sectional view of an embodiment of a pressure pad for use in the fusing station of FIG. 2 taken along the line M-M of FIG. 5B:

FIG. 4 is a side view of an exemplary embodiment of a frame member onto which a pressure pad of any of the exemplary embodiments may be mounted;

DETAILED DESCRIPTION OF EMBODIMENTS

Figure 1:
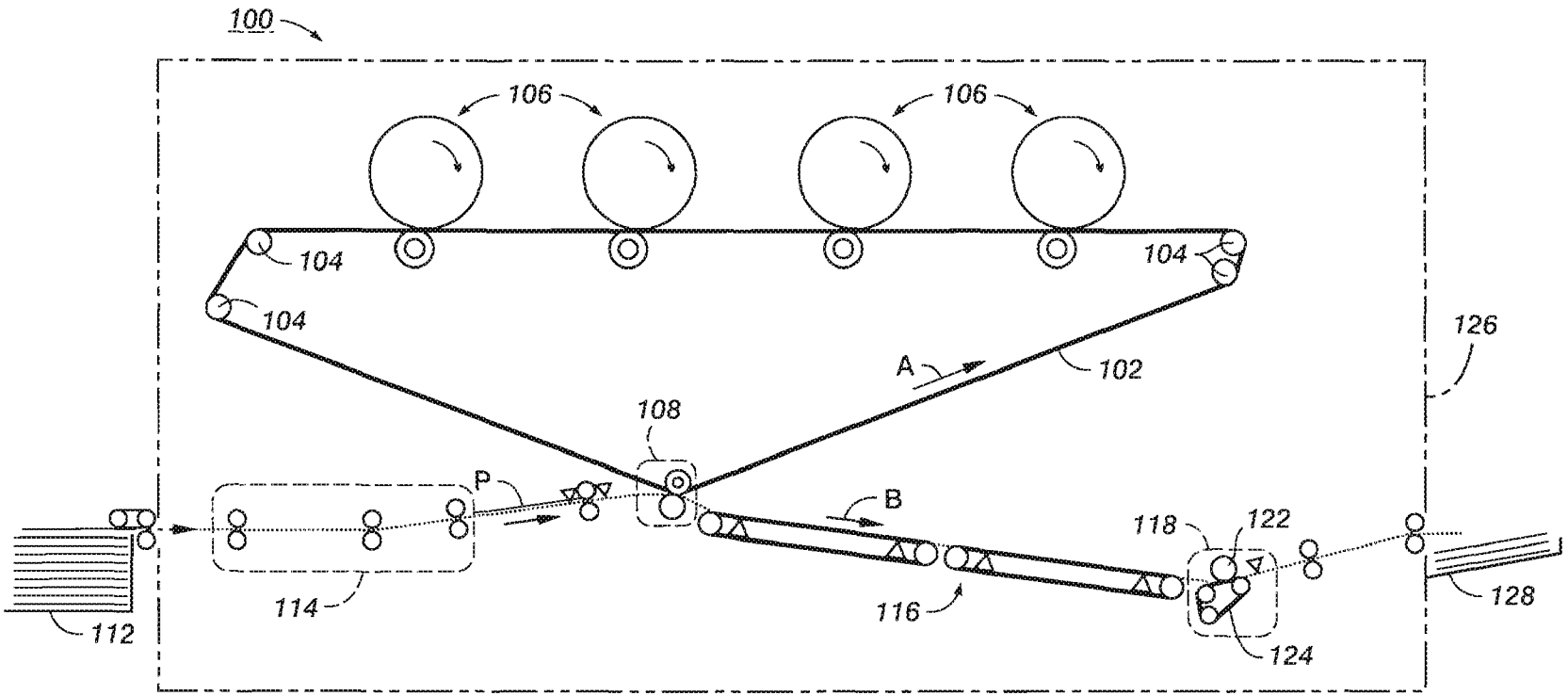
FIG. 1 is schematic representation of an exemplary embodiment of a marking device having an exemplary embodiment of a fusing station.

In the following description, reference is made to the drawings. In the drawings, like reference numerals have been used throughout to designate identical elements.

Referring now to the drawings, there is shown in FIG. 1 an exemplary embodiment of a marking device 100, such as a xerographic printing machine, of the type of a single pass multi-color printing machine 100. In this embodiment, multi-color printing is achieved. However, the disclosure is not limited to this and may encompass single color printing, spot color printing, and the like. The device 100 employs a photoconductive belt 102 supported by a plurality of rollers 104. The photoconductive belt 102 advances in the direction of arrow A to move successive portions of the external surface of the photoconductive belt 102 sequentially beneath various processing stations disposed about the path of movement thereof.

Marking device 100 includes one or more developer units 106, which include a charging device and an exposure device. The charging device charges the exterior surface of the photoconductive belt 102 to a relatively high, substantially uniform potential. After the exterior surface of the photoconductive belt 102 is charged, the charged portion thereof advances to the exposure device. The exposure device illuminates the charged portion of the exterior surface of the photoconductive belt 102 to record an electrostatic latent image thereon. The electrostatic latent image is developed by the developer unit 106, which deposits toner particles of a selected color on the electrostatic latent image.

After toner image of a first color has been developed on the exterior surface of the photoconductive belt 102, the photoconductive belt continues to advance in the direction of arrow A to the next successive developer unit 106 for development of a different color toner. This is repeated until toner particles of magenta, yellow, cyan, and black are developed on the photoconductive belt 102. In this way, a multi-color toner powder image is formed on the exterior surface of the photoconductive belt 102.

Thereafter, the photoconductive belt 102 advances the multi-color toner powder image to a transfer station 108. At the transfer station 108, a receiving medium, e.g., paper, is advanced from the top of a media stack 112 by a sheet feeder and guided through an alignment station 114 to the transfer station 108. At transfer station 108, a corona generating device sprays ions onto the backside of the paper P. This attracts the developed multi-color toner image from the exterior surface of the photoconductive belt 102 to the sheet of paper.

Figure 2A:
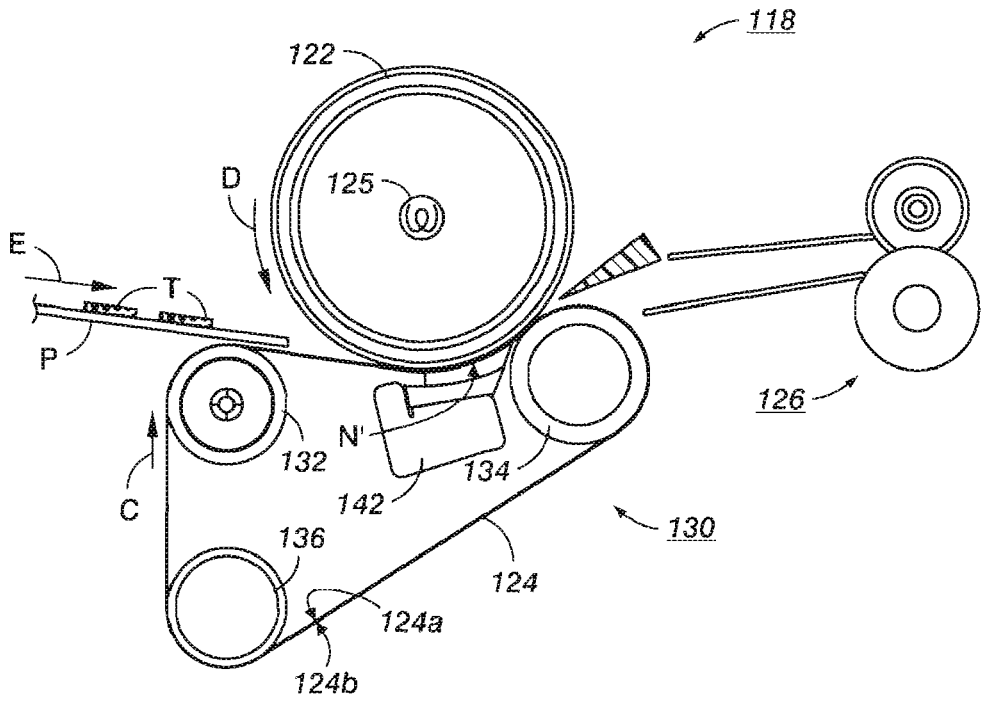
FIG. 2A a side sectional view of an embodiment of a fusing station illustrating a pressure pad in an operational, cammed-in position.

A vacuum transport 116 moves the sheet of paper in the direction of arrow B to fusing station 118. Fusing station 118 may include a heated fuser roll 122 that is resiliently urged into engagement with an endless fuser belt 124 to form a nip portion N through which the sheet of paper P passes (FIG. 2A). During the fusing operation, toner particles T coalesce with one another and bond to the sheet P in image configuration, forming a multi-color image thereon. Referring back to FIG. 1, after fusing, the finished sheet is discharged to a finishing station 126 and catch tray 128 for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to paper or other recoding media. Furthermore, while toner powder images and toner particles have been disclosed herein, one skilled in the art will appreciate that a liquid developer material employing toner particles in a liquid carrier may also be used.

Referring now back to FIG. 2A, there is shown a sectional view of a fusing station 118 of a belt-nip fuser type system. The fusing station is comprised of a fuser roll 122 and a fuser belt assembly 130. The fuser belt assembly 130 may include a fuser belt 124 stretched by a plurality of rolls, typically comprising a lead roll 132, a pressure roll 134, and a stretch roll 136, and a pressure pad 142 that presses fuser belt 124 against the fuser roll 122. An outer surface 124*b* of the fuser belt 124 contacts the fuser roll 122 such that it is wound around a portion of the fuser roll 122 at a predetermined angle to form a nip portion N.

Figure 2B:
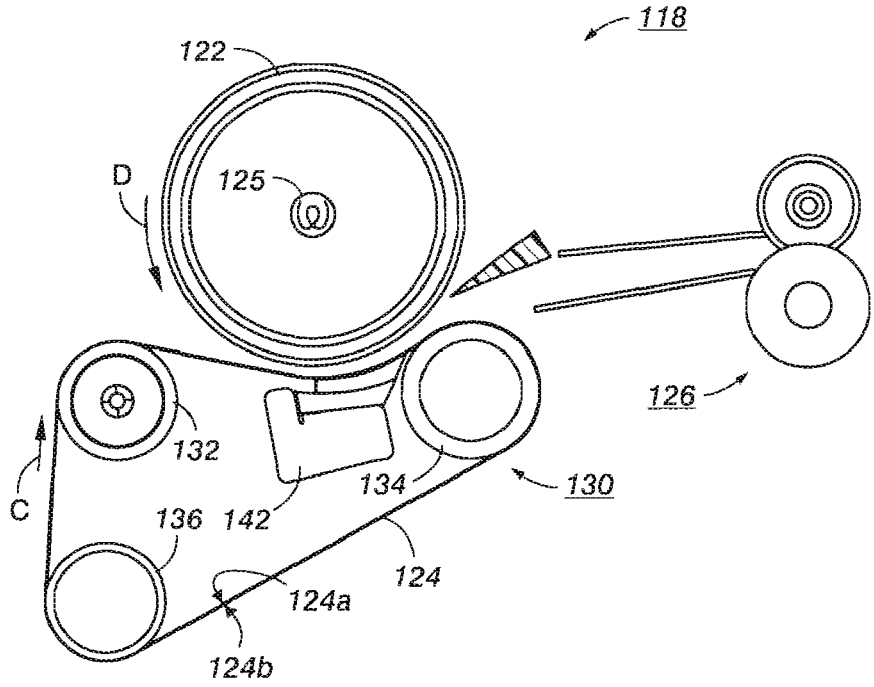
FIG. 2B a side sectional view of an embodiment of a fusing station illustrating a pressure pad in a non-operational, cammed-out position.

On an inner side 124*a* of the fuser belt, pressure pad 142 is arranged for movement between an operating position and a non-operating position. In the operating position (referred to as a cammed-in position) shown in FIG. 2A, it presses the fuser belt 124 against the fuser roll 122. The pressure pad also is movable to the non-operating position (referred to as a cammed-out position) shown in FIG. 2B, wherein the pressure pad 142 is moved to release contact with the fuser belt 124. This reduces pressure acting at the nip N by the fuser belt.

The winding angle of the fuser belt 124 around the fuser roll 122, which depends on the revolution of the fuser roll 124, may be set to about 20 to about 45 degrees to make the nip portion N sufficiently wide. The winding angle is set to ensure that the insertion duration of a sheet of media P in the nip portion N is within an acceptable range, and may vary depending on the application and other criteria.

As better shown in FIG. 3, pressure pad 142 may include an elastic member 142*a* having an upper surface 142*a*' that is placed in contacting engagement with the moving fuser belt 124 when the pressure pad 142 is in the operating, cammed-in position. Elastic member 142*a* may have a low-abrasion layer on its outer facing surface 142*a*', and the outer surface 142*a*' can be curved almost in accordance with the peripheral contour of the fuser roll 122 for improved contact. When pressure pad 142 is pressed against the fuser belt 124, a nip portion is formed between the fuser belt 124 and the fuser roll 122 having certain size and pressure characteristics. Elastic member 142*a* may be held by a base portion 142*b* comprised of metal or the like, which is supported on a suitable frame member 154.

The elastic member 142*a* of the pressure pad 142 may be made of a material having high heat resistance, such as silicone rubber or fluorine rubber. The low-abrasion layer formed on the outer facing surface 142*a* of the elastic member reduces slide resistance between the inner surface 124*a* of the fuser belt and the pressure pad 142, and can be achieved by having a small friction coefficient and high abrasion resistance.

Referring back to FIG. 2A, fuser belt 124 is moved in the direction shown by the arrow C, such as by revolution of fuser roll 122 in the direction shown by the arrow D. A media sheet P having a toner image T formed on the surface thereof is conveyed from the left side in FIG. 2A toward the nip portion N (direction shown by the arrow E). The toner image T formed on the surface of the sheet P inserted into the nip portion N may be fixed by pressure applied at the nip portion N (by fuser belt 124 pressing against the fuser roll 122) and by heat emitted from the heater 125 through the fuser roll 112.

Manufacturing tolerances of the pad 142 and frame 156 and adjustments control the location of the pressure pad 142 when in the cammed-in position illustrated in FIG. 2A. In order to provide optimal print quality, the nip N formed must be tightly controlled to maintain a precise contact profile across the entire length of the fuser roll 122. Typically, a symmetrical profile is desired in which a pressure profile is larger at the center and less at inboard and outboard edges of the nip by a predetermined ratio.

This pressure distribution can be achieved by relative adjustment of the orientation of the pressure pad 142 to the fuser roll 122 across its length. This may be achieved, for example, by the structure shown in FIG. 4. FIG. 4 illustrates a side view of an exemplary embodiment of a frame member 154 having a portion 154*a* onto which pressure pad 142 can be mounted. The frame member 154 can be provided with one or more adjustable preload screws 156 that adjusts the load on the pressure pad 142 across the length of the pad when in the cammed-in operating position. In this embodiment, adjustment of the preload screws 156 causes the mounting portion 154*a* of the frame member to move generally in the direction shown by arrow E, thereby increasing or decreasing the nip gap and the load placed on the pressure pad 142 when the pad is in the cammed-in position. By having multiple screws 156 across the pad length, center, inboard, and outboard portions of the pad can be individually adjusted to control the pressure distribution across the fuser roll 122.

In order to accurately measure the loading and pressure profile so that adjustments can calibrate the pad 142 to desired factory tolerances while the pad remains in marking machine 110, the pressure pad 142 is provided with two or more embedded pressure sensors 144 that sense a load of the pressure pad 142 in the cammed-in position.

Figure 5A:
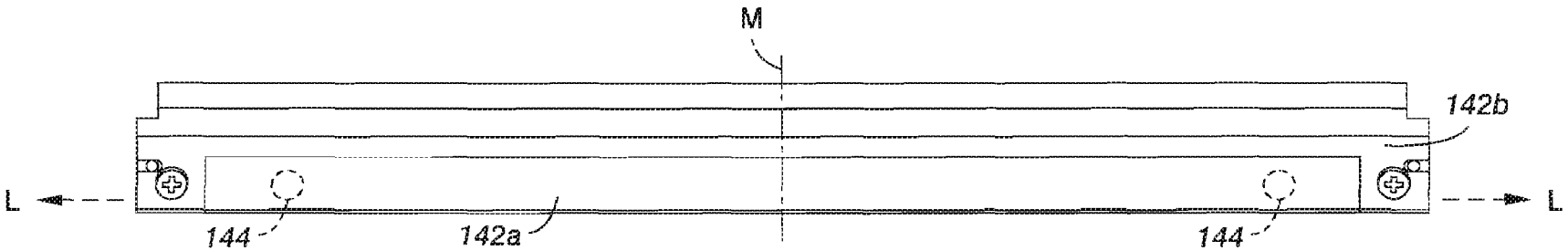
FIG. 5A is a top view of a first embodiment of a pressure pad having two embedded pressure sensors.
Figure 5B:
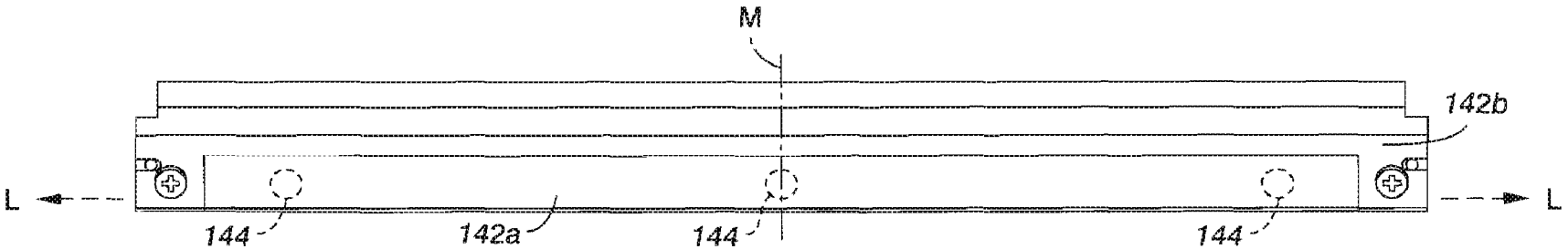
FIG. 5B is a top view of a second embodiment of a pressure pad having three embedded pressure sensors.
Figure 5C:
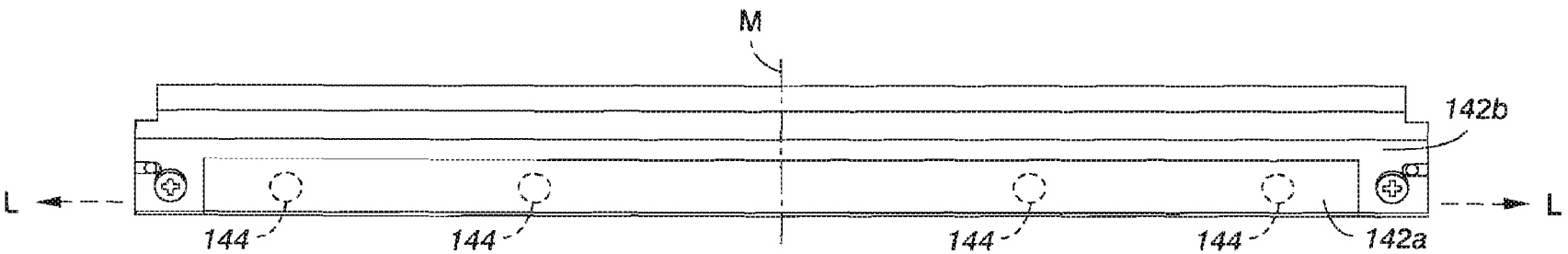
FIG. 5C is a top view of a third embodiment of a pressure pad having four embedded pressure sensors.
Figure 5D:
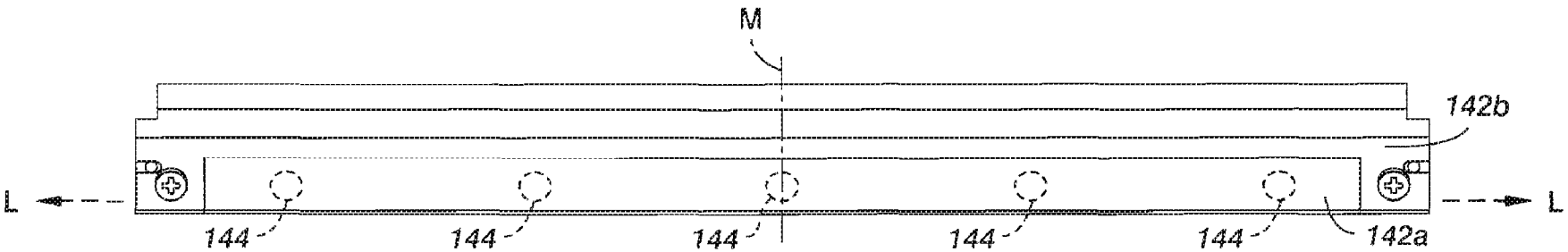
FIG. 5D is a top view of a fourth embodiment of a pressure pad having five embedded pressure sensors.

Various embodiments showing suitable sensor locations will be described in FIGS. 5A-5D. In an exemplary first embodiment shown in FIG. 5A, the pressure pad 142 has two pressure sensors 144, the sensors 144 being positioned along a longitudinal axis L of the pressure pad symmetric about a mid-point M. In a second embodiment shown in FIG. 5B, the pressure pad 142 has at least three pressure sensors 144, one of the sensors 144 being positioned along a longitudinal axis L of the pressure pad 144 at substantially at a mid-point M, and two of the sensors 144 being positioned along the longitudinal axis L symmetric about the mid-point M to measure inboard and outboard loading. In a third embodiment shown in FIG. 5C, the pressure pad 142 has four sensors 144 that are positioned along a longitudinal axis L of the pressure pad symmetric about a mid-point M. A further embodiment includes five pressure sensors 144 as shown in FIG. 5D. In this embodiment, one sensor 144 is positioned along a longitudinal axis L of the pressure pad 144 substantially at a mid-point M, and four of the sensors 144 are positioned along the longitudinal axis L symmetric about the mid-point M.

The pressure sensors 144 may take various forms, such as known or subsequently developed pressure sensors, such as, for example, pressure transducers such as the SPI Tactilus freeform round sensor having a diameter of about 4 mm or about 8 mm, a thickness of about 0.3 mm, and with a pressure range of from about 0 to about 150 PSI.

Figure 6:
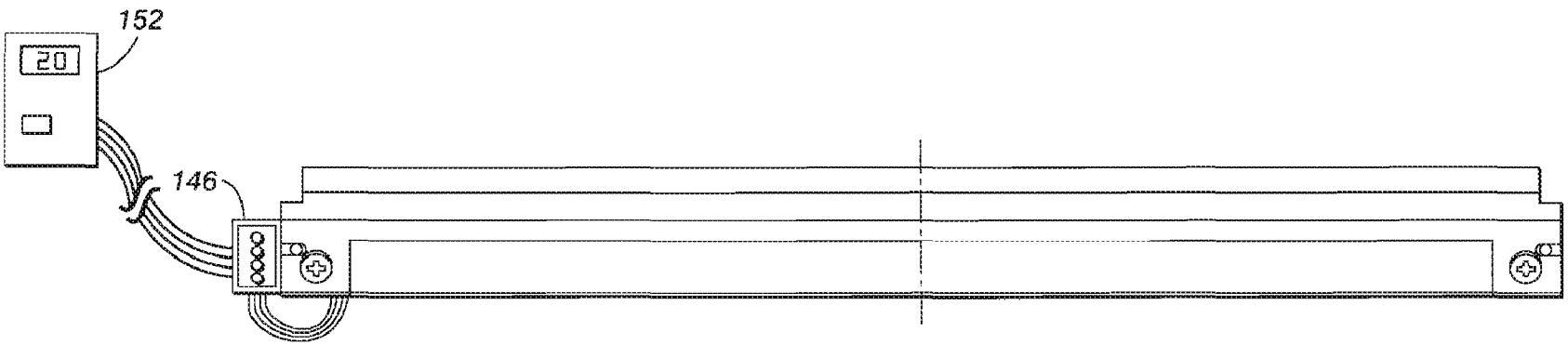
FIG. 6 is a top view of an embodiment of a pressure pad having a connector for connection to an instrument that measures the load on the pressure sensors embedded in the pressure pad in its cammed-in position.

As shown in FIG. 6, the fuser belt assembly 130 may include a connector 146 that is electrically connected to each of the sensors 144 via wires 148. In certain embodiments, connector 146 may be adapted for connection to a hand-held instrument 152 for measuring the load of each sensor 144. Alternatively, a measurement instrument and display may be provided as part of marking device 100

As shown in FIG. 3, the pressure pad has a comprises an elastic pad portion 142*a* having an upper surface 142*a*' that contacts the fuser belt 124 and a base portion 142*b* onto which a lower surface of the pad portion 142*a* is mounted and the pressure sensors 144 are positioned between the pad portion 142*a* and the base portion 142*b*.

Figure 7:
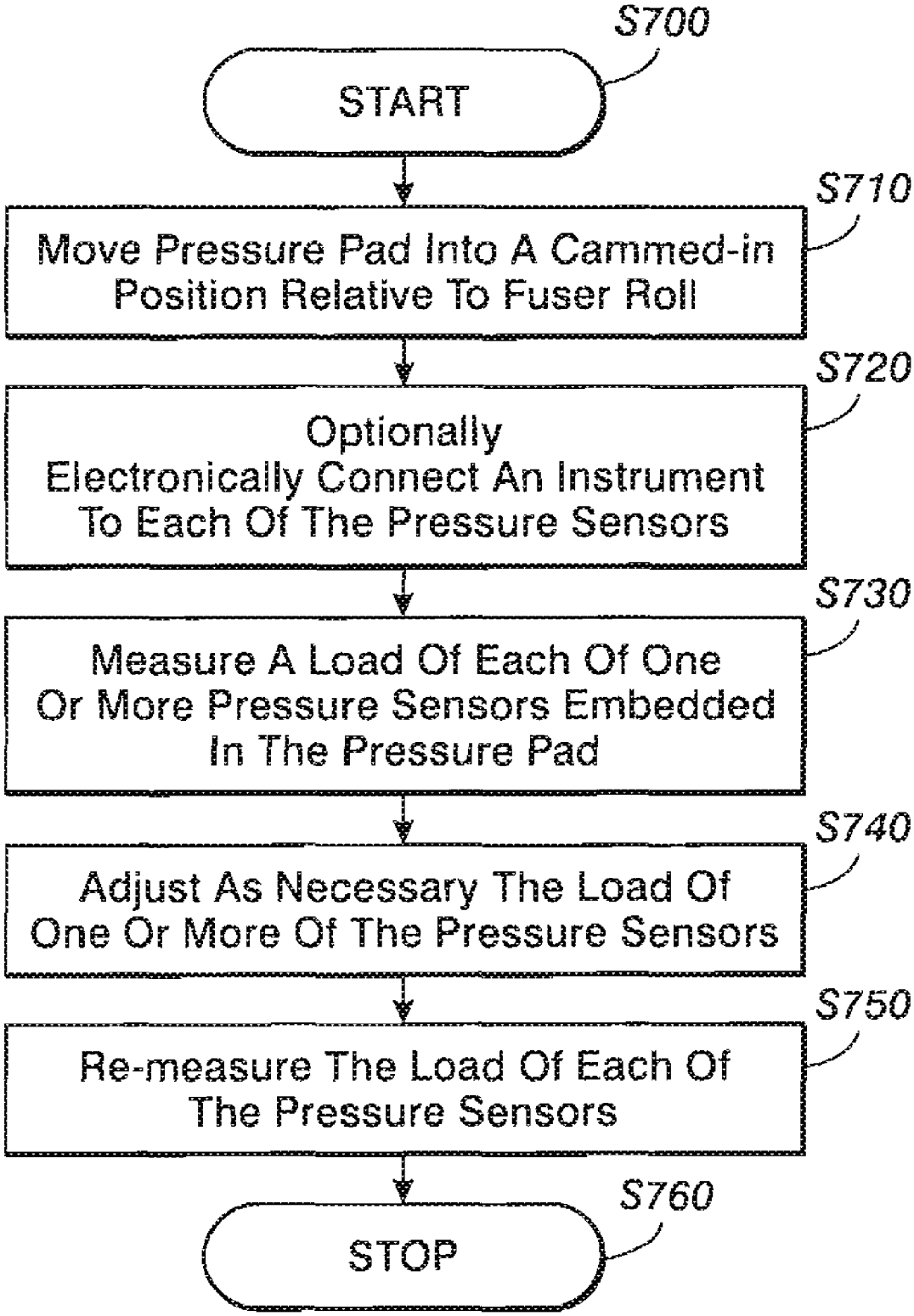
FIG. 7 is a flowchart illustrating an exemplary method of calibrating a pressure pad to form a desired nip between a fuser roll and fuser belt of the fusing station.

With reference to FIG. 7, an exemplary method is provided for calibrating a pressure pad of a fuser assembly of a xerographic marking device 100. The process starts at step S700 and advances to step S710 where the pressure pad is moved into a cammed-in position relative to a fuser roll. At step S730, a load of each of two or more pressure sensors embedded in the pressure pad is measured. At step 740, various adjustment screws may be adjusted to calibrate the load towards a desired value. At step S750, the load of each of the pressure sensors can be re-measured. If within a desired value, the process stops at step S760.

In embodiments, the measuring step may also include a step S720 of electronically connecting an, instrument such as a hand-held instrument to each of the pressure sensors. This option avoids the need and expense of diagnostic/measurement equipment for each machine and enables a repair technician to engage a hand-held portable device to the pressure sensors to effect calibration.

Figure 8:
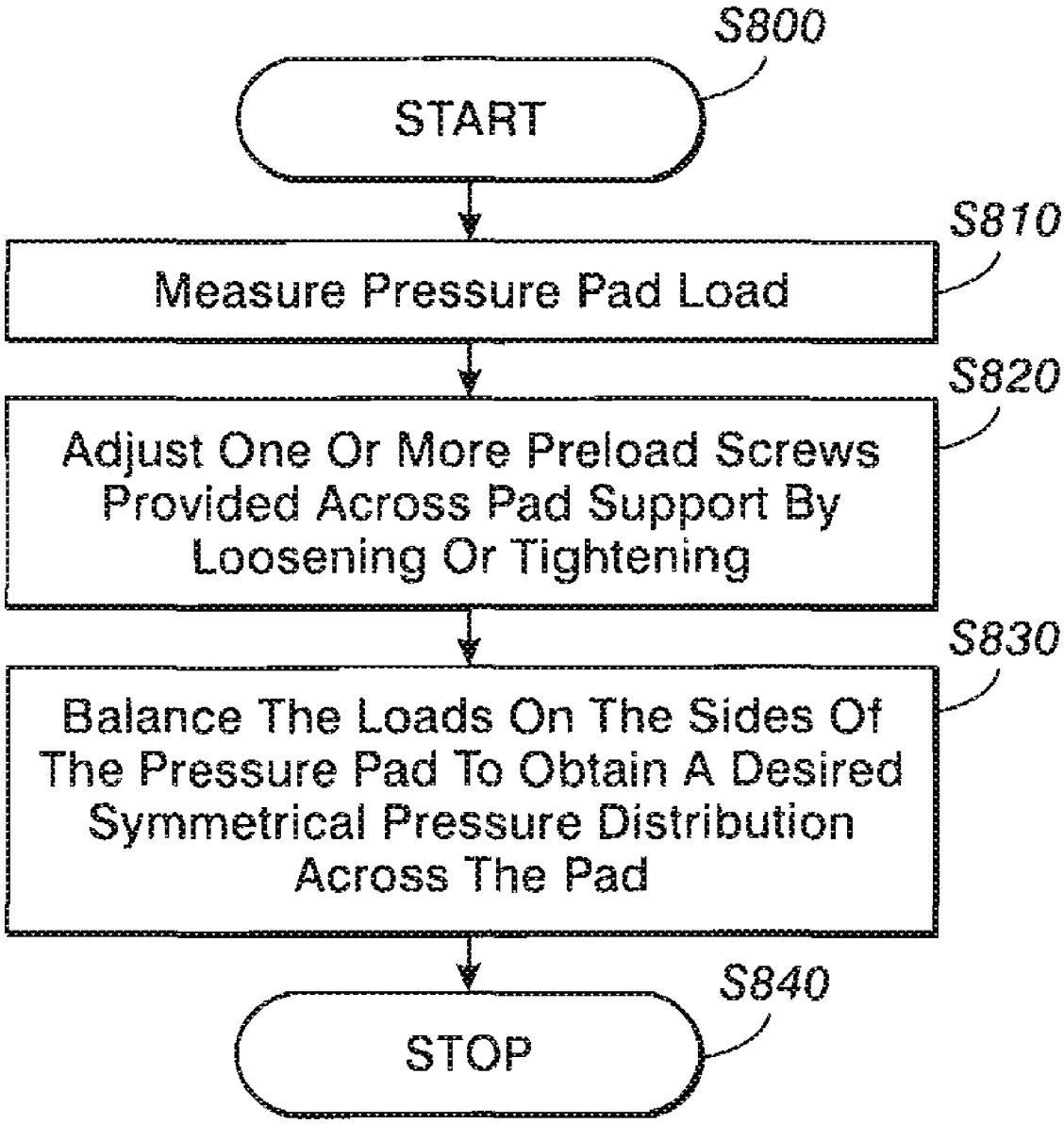
FIG. 8 is a flowchart illustrating an exemplary method of adjusting the load of two or more pressure sensors embedded in a pressure pad.

FIG. 8 illustrates a suitable process for adjustment. The process starts at step S800 and advances to step S810 where pressure pad load is measured. At step S820, one or more preload screws 156 may be adjusted by loosening or tightening one or more of the preload screws across inboard and outboard sides of the pad until at step S830 a desired balancing of the loads on the respective inboard and outboard sides of the pressure pad is achieved to set a symmetrical pressure distribution at required levels across the pad. The process stops at step S840.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A fuser belt assembly of a xerographic marking device having a belt-nip fuser, comprising:

an endless fuser belt having an inner side and an outer side, a pressure pad movable between a cammed-in position in which the pressure pad contacts an inner side of the fuser belt to press an outer side of the fuser belt against a fuser roll to form a fusing nip, and a cammed-out position in which the pressure pad does not press an outer side of the fuser belt against the fuser roll, wherein the pressure pad has two or more embedded pressure sensors for sensing a load of the pressure pad in the cammed-in position, the pressure pad comprises a pad portion having an upper surface that contacts the fuser belt and a base portion onto which a lower surface of the pad portion is mounted, and the sensors are positioned between the pad portion and the base portion.

2. A fuser belt assembly as described in claim 1, wherein the pressure pad has two pressure sensors, the sensors being positioned along a longitudinal axis of the pressure pad symmetric about a mid-point.

3. A fuser belt assembly as described in claim 1, wherein the pressure pad has at least three pressure sensors, one of the sensors being positioned along a longitudinal axis of the pressure pad at a mid-point, and two of the sensors being positioned along a longitudinal axis symmetric about the mid-point.

4. A fuser belt assembly as described in claim 1, wherein the pressure sensors are pressure transducers.

5. A fuser belt assembly as described in claim 1, further comprising a connector that is electrically connected to each of the sensors.

6. A fuser belt assembly as described in claim 5, wherein the connector is adapted for connection to a separate instrument that can measure the load of each sensor.

7. A fuser belt assembly as described in claim 1, wherein the pad portion is an elastic member comprised of silicone rubber.

8. A fuser belt assembly as described in claim 1, wherein the base portion is comprised of metal.

9. A fuser belt assembly as described in claim 1, further comprising one or more adjustable preload screws.

10. A method of calibrating a pressure pad of a belt-nip fuser of a xerographic marking device, comprising:

moving the pressure pad into a cammed-in position relative to a fuser roll;

measuring a load of each of two or more pressure sensors embedded in the pressure pad;

adjusting as necessary the pressure pad; and re-measuring the load of each of the pressure sensors.

wherein the pressure pad comprises one or more preload screws and the adjusting step comprises loosening or tightening one or more of the preload screws.

11. A method of calibrating a pressure pad of a belt-nip fuser as described in claim 10, wherein the measuring step comprises connecting an electrical instrument to a connector that is in electrical connection with each of the pressure sensors.

12. A method of calibrating a pressure pad of a belt-nip fuser as described in claim 10, wherein the pressure sensors are pressure transducers.

13. A method of calibrating a pressure pad of a belt-nip fuser as described in claim 10, wherein the pressure pad has an inboard side and an outboard side and the adjusting step comprises balancing the loads on the respective inboard and outboard sides.

14. A method of calibrating a pressure pad of a belt-nip fuser as described in claim 10, wherein the adjusting step comprises setting a symmetrical pressure distribution at required levels.

* * * * *